US005127568A

United States Patent [19]

Unuma et al.

[11] Patent Number: 5,127,568

[45] Date of Patent: Jul. 7, 1992

[54] LID FOR SHEET FEED TRACTOR

[75] Inventors: Sadao Unuma, Ohbu; Masashi Yamashita, Nagoya; Kouichi Hara, Aichi, all of Japan

[73] Assignee: Tokai Kogyo Kabushiki Kaisha, Ohbu, Japan

[21] Appl. No.: 687,554

[22] Filed: Apr. 19, 1991

[30] Foreign Application Priority Data

Apr. 19, 1990 [JP] Japan ..... 2-104158

[51] Int. Cl.[5] ..... B65H 20/20

[52] U.S. Cl. ..... 226/74; 400/616.1; 16/227

[58] Field of Search ..... 226/74, 75, 82, 83; 400/616.1, 616.2; 16/225, 227

[56] References Cited

U.S. PATENT DOCUMENTS

| | | | |
|---|---|---|---|
| 4,316,567 | 2/1982 | Grear et al. | 226/74 |
| 4,345,607 | 8/1982 | Contreras et al. | 16/227 X |
| 4,826,337 | 5/1989 | Unuma | 226/74 X |
| 4,951,859 | 8/1990 | Gatto et al. | 226/74 |
| 4,955,520 | 9/1990 | Ferguson | 226/74 |

*Primary Examiner*—Daniel P. Stodola
*Assistant Examiner*—P. Bowen
*Attorney, Agent, or Firm*—Oblon, Spivak, McClelland, Maier & Neustadt

[57] ABSTRACT

In a sheet feed tractor, a lid confines a paper sheet on a frame surface when the paper sheet is conveyed on a belt. The lid is constructed so that it can overrun and return to its normal open position. The lid is constructed so as to include a lid member rotatable between a closed position spaced closely adjacent the surface of the frame so as to confine the paper sheet and an open position spaced away from the surface. The lid member has at one side edge thereof a pair of hinge pins disposed with a space therebetween and projecting over one side of the frame. The frame includes a pair of hinges projecting from one side of the frame and has the hinge pins of the lid member rotatably mounted thereto. The hinges of the frame include grooves opening towards the outside of the sheet feed tractor and are adapted to pivotally receive the hinge pins of the lid member. Upper portions of the hinges with the grooves include a stop member for resting the lid member there against in a first, open position and are resiliently movable when the lid member is rotated past the first, open position to a second position and when returned to the first, open position from the second position.

4 Claims, 5 Drawing Sheets

LID FOR SHEET FEED TRACTOR

BACKGROUND OF THE INVENTION

1. Field of the Invention

This invention relates to a sheet feed tractor, and particularly to a lid structure for such sheet feed tractor.

2. Description of the Related Art

In a known sheet feed tractor, a lid is used for confining a paper sheet on a conveyer belt. The lid is pivotally mounted on a frame by means of a pair of hinges which extend in side by side relationship from the lid and from the frame. The lid hinges have pins while the frame hinges have holes. Both the lid and frame are connected by a spring. As shown in FIGS. 12 and 13 of the accompanying drawings, a hinge pin 25 of a lid 24 is inserted into a bearing hole 23 of a hinge 22 of a frame 21. In another sheet feed tractor shown in FIG. 14, a groove 33 which is open upwardly is formed at an end of a hinge 32 of a frame 31 so that a hinge pin 35 of a lid 34 is inserted into the groove 33.

When the lid is in an open or closed position, an edge of the lid rests upon stops of the frame hinges. The lid is biased to its respective positions by a tension spring.

When sheet feeding is performed, the lid is in a closed position with a space over the paper feeding plane, confining the paper sheet on the conveyer belt. Specifically, the lid remains parallel with the paper feeding plane. On the contrary, the open position of the lid varies according to a layout of a printer, or specifications of the sheet feed tractor or the printer.

The lid is usually self holding in a neutral position of 45 degrees with respect to the sheet feeding plane (where the lid is movable in any directions since there is no spring bias, theoretically). To close the lid, firstly the lid is moved with a flick of the finger to the neutral position of 45 degrees, then being closed by the force of the tension spring when the finger is released from the lid.

When opening, the lid is moved up manually until it passes over the neutral position and the outer edge of the lid reaches the stops on the frame hinge. In this case, an excessive force would sometimes be applied to the lid. The lid would be subject to shocks when something happens to strike the lid in the open position. Since the lid and the frame are made of plastics and are not strong enough, they would be deformed or damaged at their weak positions by such shocks. In such case, the sheet feed tractor would be somewhat distorted, thereby reducing sheet feeding efficiency. In a worst case, the sheet feed tractor has to be replaced, thereby causing printing to be interrupted, leading to loss of work efficiency.

SUMMARY OF THE INVENTION

It is therefore an object of this invention to provide a lid structure for a sheet feed tractor which can solve inconveniences of the prior art devices.

According to this invention, there is provided a lid structure for a sheet feeding tractor having a frame which presents a surface on which a paper sheet is conveyed on a belt. The lid structure comprises a lid member movable between a closed position spaced closely adjacent a surface to confine the paper sheet and an open position spaced away from the surface, the lid member having at one side edge thereof a pair of hinge pins disposed with a space therebetween and projecting over one side of the frame, the frame having a pair of hinges projecting from the one side of the frame and disposed with the same space as that of the hinge pins of the lid member, the hinges of the frame having grooves opening towards the outside of the sheet feed tractor and being adapted to receive pivotally the hinge pins of the lid member; and upper portions of the hinges having the grooves being adapted to serve as stops where the lid member rests in a normally open position and being movable resiliently when the lid member overruns the normally open position and then returns to the normally open position from the overrun position.

An opening width of the grooves of the hinges of the frame is set so as to be smaller than a diameter of the hinge pins of the lid member so as to prevent the hinge pins from being disengaged from the hinges.

With this arrangement, the upper portions of the hinges of the frame are resilient, which enables the lid to overrun its normally open position if an excessive force is applied to the lid in the normally open position, and return to the normally open position by applying a little force. Therefore the sheet feed tractor will not be deformed or damaged if an excessive force is applied to the lid in the normal open position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
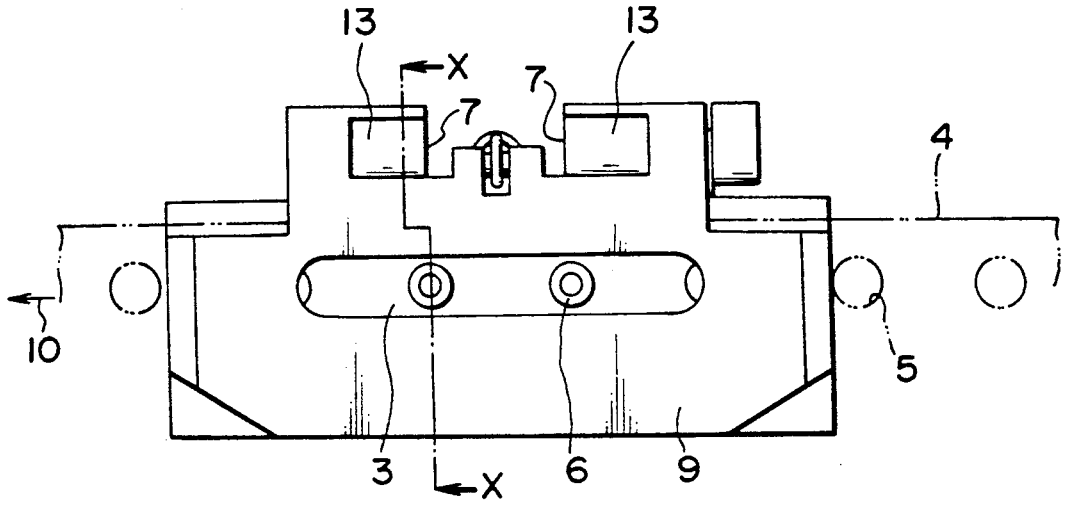
FIG. 1 is a top plan view of a sheet feed tractor including a lid embodying this invention.
Figure 2:
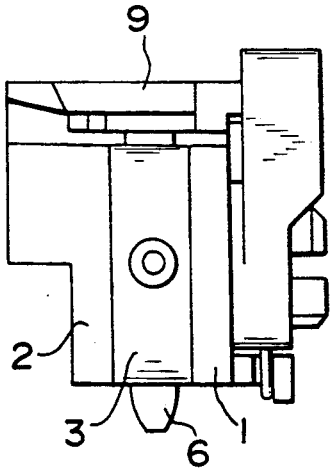
FIG. 2 is a side elevational view of the sheet feed tractor of FIG. 1.
Figure 3:
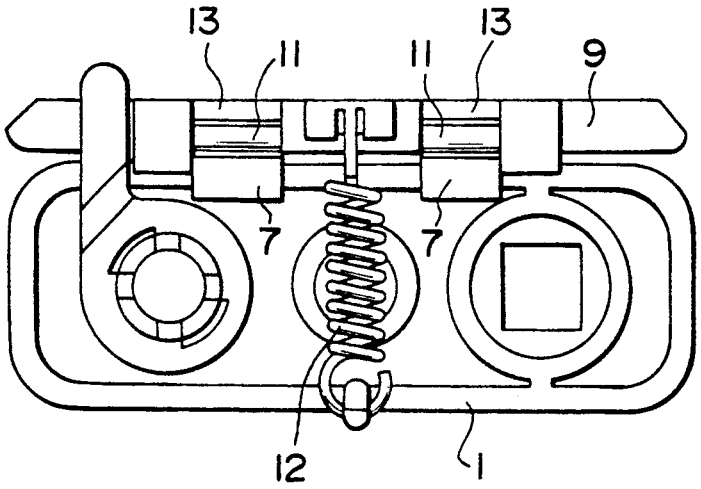
FIG. 3 is a rear elevational view of the sheet feed tractor of FIG. 1.
Figure 4:
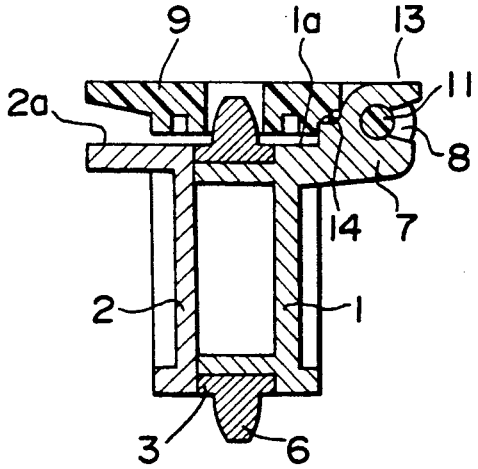
FIG. 4 is a cross-sectional view of the sheet feed tractor, taken along the line X—X of FIG. 1.
Figure 5:
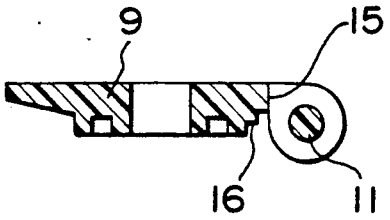
FIG. 5 is a cross-sectional view of a lid in the tractor of FIG. 1.

A sheet feed tractor in general will be described first with reference to FIGS. 1 to 4.

A sheet feed tractor is generally provided with a pair of integral side frames 1, 2 and an endless conveyer belt 3 trained between these side frames 1, 2. A paper sheet 4 is formed with a pair of rows of feed apertures 5 at opposite side edges. The conveyer belt 3 is provided with a row of plural feed pins 6 projecting outwardly therefrom and arranged at the same intervals as those of the feed apertures 5 of the paper.

A pair of hinges 7, 7 are provided on the side frame 1 with a predetermined space in the sheet feeding direction 10. Each of the hinges 7, 7 has a groove 8 which is open toward the outside of the sheet feed tractor.

The lid 9 has on its one side edge a pair of hinge pins 11, 11 which are arranged at the same interval with that of the hinges 7, 7 of the side frame 1. The hinge pins 11, 11 of the lid 9 are fitted into the grooves 8 of the hinges 7, 7 so that the lid 9 is pivotally mounted on the side frame 1. The lid 9 is connected to the side frame 1 by a tension spring 12. The tension spring 12 biases the lid 9 to self hold at the open or closed position.

Figure 6:
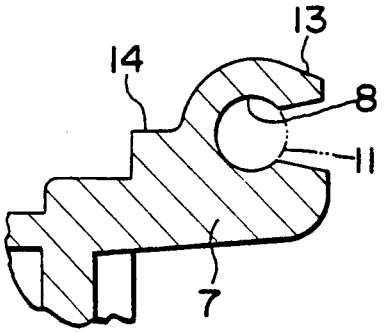
FIG. 6 is an enlarged cross-sectional view of a hinge integrally formed on a side frame.

Upper arc-shaped portions of the hinges 7, 7 having the grooves 8 serve as stops 13, on which the outer edge of the lid 9 rests when the lid 9 is in the open position. Since all the components of the sheet feed tractor are made of plastics, the stops 13 are resilient. In FIG. 6, a flat portion (designated by reference numeral 14) of each frame hinge 7 serves as a stop on which the lid 9 rests when it is in the closed position.

The lid 9 includes a portion 15 adapted to contact with the stop 13 when the lid 9 is in open position, and a portion 16 adapted to contact with the stop 14 when the lid 9 is in the closed position.

The hinge pins 11 of the lid 9 are forced into the grooves 8 of the frame hinges 7 due to elasticity of the stops 13. Thus the lid 9 is mounted movably on the side frame 1 by the hinge pins 11. The opening width of each groove 8 is determined to be less than the diameter of each hinge pin 11. Therefore, the hinge pins 11 cannot be disengaged from the grooves 8 of the hinge 7 easily.

During the sheet feeding, the lid 9 is closed so as to be parallel with the paper feeding planes 1*a*, 2*a* of the side frames 1, 2. The portions 16 of the lid 9 rest upon the stops 14 of the hinges 7 of the side frame 1. The tension spring 12 urges the lid 9 to self hold at the closed position.

Figure 7:
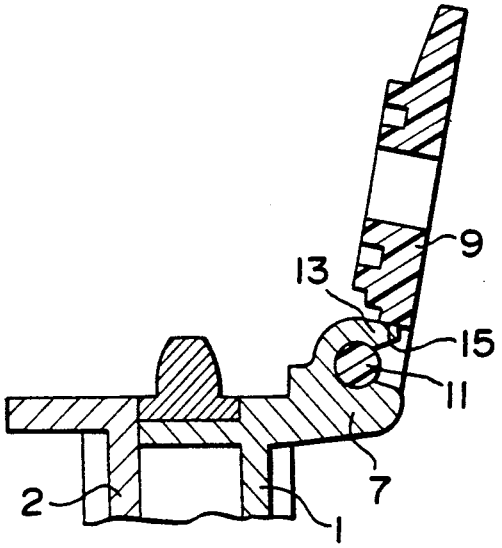
FIGS. 7 to 9 show movement of the lid.

When the lid 9 is opened by applying a force, the tension spring 12 urges the lid 9 to move further up over the neutral position. Then the portions 15 of the lid 9 come into contact with the stops 13 of the hinges 7, 7, thereby keeping the lid 9 in the first open position by the bias of the tension spring 12, as shown in FIG. 7.

Figure 8:
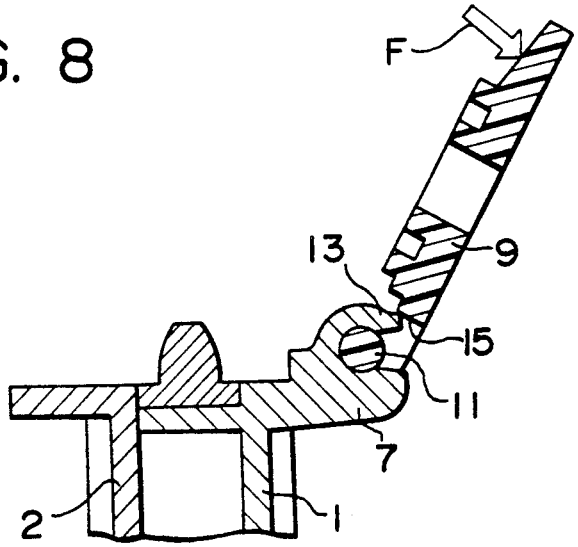
Figure 9:
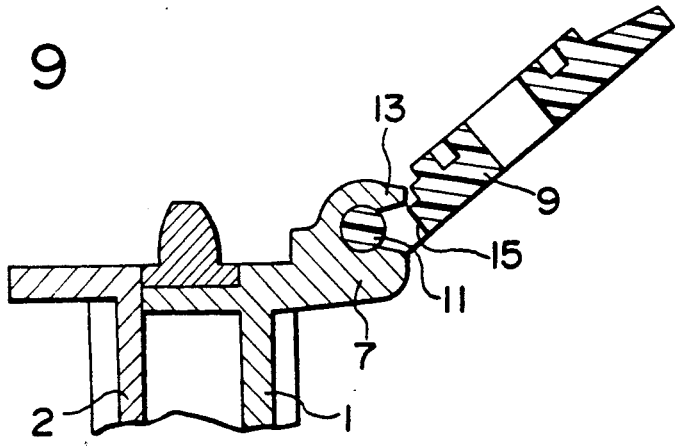
Figure 10:
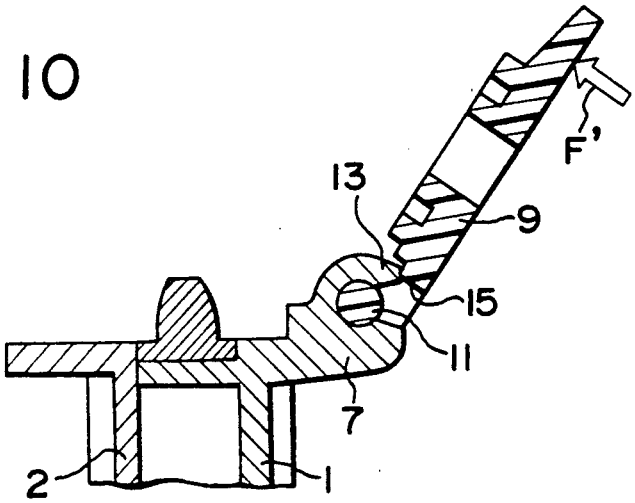
FIG. 10 is a fragmentary cross-section view showing the lid restored to its original posture.

When an excessive force F is applied to the lid 9 in the open position as shown in FIG. 8, the lid 9 is freed from the stop 13 due to an elastic deformation of the stops 13, and overruns or rotates past the first open position as shown in FIG. 9 to a second position. Since the stops 13 are shaped in such a manner that the portions 15 of the lid 9 can run on the edge of the stops 13, the lid 9 can be returned to its first, open position through the overrun or second position shown in FIG. 8 by applying a force F′ shown in FIG. 10 to the rear side of the lid 9.

According to this invention, the lid 9 is constructed so that it can overrun or rotate past the first, open position. If an excessive force F is applied to the lid 9 in the first open position, such force F can be released by disengaging the lid 9 from the stops 13, thereby allowing the lid 9 to overrun or rotate past the first, open position shown in FIG. 9, and prevent the sheet feed tractor from being distorted or damaged. Since the stops 13 are resilient, the whole sheet feed tractor would not be affected. Therefore, the sheet feed tractor can perform its feeding function properly even when the stops 13 are provided at the hinges 7, 7 of the side frame 1.

Figure 11:
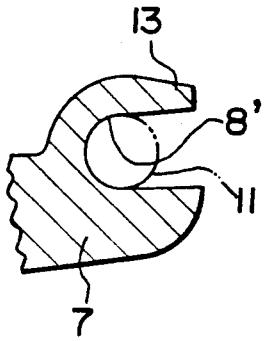
FIG. 11 is a cross-sectional view of a hinge having a groove of another shape.
Figure 12:
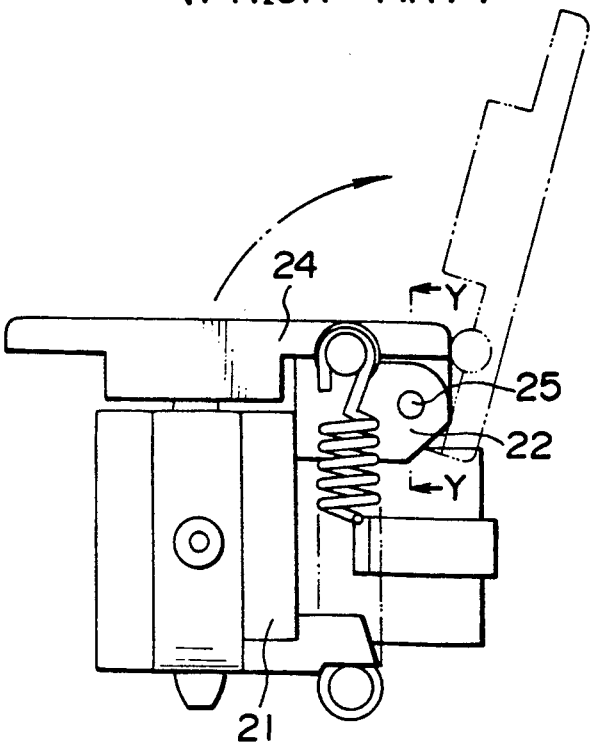
FIG. 12 (PRIOR ART)
FIG. 12 is a side elevational view of a prior art sheet feed tractor.
Figure 13:
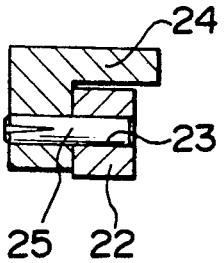
FIG. 13 (PRIOR ART)
FIG. 13 is a cross-sectional view of the sheet feed tractor, taken along the line Y—Y of FIG. 12.
Figure 14:
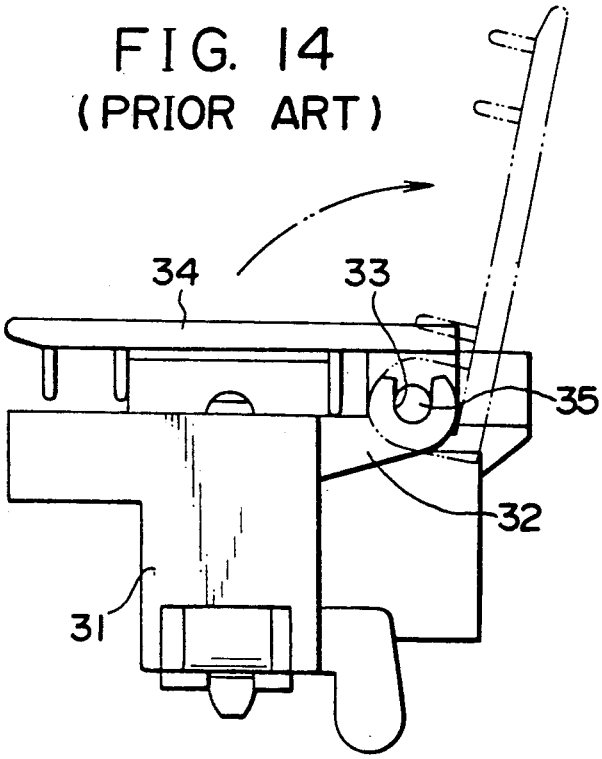
FIG. 14 (PRIOR ART)
FIG. 14 is a side elevational view of the tractor of FIG. 12.

Grooves 8′ of the hinges 7, 7 of the side frame 1 may be in the shape of U as shown in FIG. 11.

What is claimed is:

1. In a sheet feed tractor having a frame which presents a surface on which a paper sheet is conveyed by a belt, said belt having pins projecting therefrom for engagement with perforations on the paper sheet to be fed, a lid structure comprising:

a lid member rotatable between a closed position spaced closely adjacent said surface to confine the paper sheet and an open position spaced away from said surface;

said lid member having at one side edge thereof a pair of hinge pins disposed with a space therebetween and projecting over one side of said frame, said frame having a pair of hinges projecting from said one side of said frame and having said lid member rotatably mounted thereto;

said hinges of said frame having grooves opening towards the outside of said sheet feed tractor and being adapted to pivotally receive said hinge pins of said lid member; and upper portions of said hinges with said grooves including a stop for resting said lid member thereagainst in a first, open position and being resiliently movable when said lid member is rotated past said first, open position to a second position and when returned to the first, open position from the second position.

2. A lid structure according to claim 1, wherein an opening width of said grooves of said hinges of said frame is set to be smaller than a diameter of said hinge pins of said lid member so as to prevent said hinge pins from being disengaged from said hinges.

3. A lid structure according to claim 1, wherein said stop is located at upper end portions of arc shaped portions of said hinges, respectively.

4. A lid structure according to claim 1, wherein said stop is elastically deformable and is engageable with an end portion of said lid when said lid is rotated to said first, open position.

* * * * *